United States Patent [19]

Axelrod et al.

[11] Patent Number: 4,639,256

[45] Date of Patent: Jan. 27, 1987

[54] COLD FLOW IMPROVING ADDITIVE COMPOUND AND FUEL COMPOSITION CONTAINING SAME

[75] Inventors: Joan C. Axelrod, Media, Pa.; Sheldon Chibnik, Cherry Hill, N.J.

[73] Assignee: Mobil Oil Corporation, New York, N.Y.

[21] Appl. No.: 810,114

[22] Filed: Dec. 18, 1985

[51] Int. Cl.[4] ..... C10L 1/22

[52] U.S. Cl. ..... 44/71; 260/404.5

[58] Field of Search ..... 44/71; 260/404.5

[56] References Cited

U.S. PATENT DOCUMENTS

| | | | |
|---|---|---|---|
| 2,606,890 | 8/1952 | Polly et al. | 260/405.5 |
| 3,962,104 | 6/1976 | Swietlik et al. | 252/32.7 E |
| 4,108,613 | 8/1978 | Frost, Jr. | 44/72 |
| 4,283,314 | 8/1981 | Zeilstra | 524/567 |
| 4,297,107 | 10/1981 | Boehmke | 44/71 |
| 4,491,455 | 1/1985 | Ishizaki et al. | 44/62 |
| 4,498,908 | 2/1985 | Chibnik | 44/71 |
| 4,509,954 | 4/1985 | Ishizaki et al. | 44/71 |

*Primary Examiner*—Y. Harris-Smith

*Attorney, Agent, or Firm*—Alexander J. McKillop; Michael G. Gilman; Howard M. Flournoy

[57] ABSTRACT

A reaction product or additive compound comprising an ester derivative of a branched chain monocarboxylic acid, wherein said ester derivative has at least one tertiary amine group and at least one ester group. The additive compound when added to a hydrocarbyl distillate fuel in a cold flow improving effective amount produces a fuel composition having improved cold flowability.

43 Claims, No Drawings

COLD FLOW IMPROVING ADDITIVE COMPOUND AND FUEL COMPOSITION CONTAINING SAME

BACKGROUND OF THE INVENTION

This invention relates to fuel compositions having improved low temperature characteristics. More particularly this invention relates to compositions comprising distillate hydrocarbon fuels having minor amounts of ester derivatives of certain branched chain monocarboxylic acids, containing tertiary amine groups. This invention is also directed to low temperature fuel additive compounds comprising said ester derivatives and to compositions containing the ester derivatives or mixtures thereof.

As is well known to those skilled in the art, diesel fuels present problems at low temperatures because of poor flow characteristics and clogging of fuel filters. Consequently there is a continuing need for means for solving these low temperature problems. The materials described herein are derivatives of specific branched-chain monocarboxylic acids which when added to a diesel fuel significantly improve its filterability and pour point.

U.S. Pat. No. 4,283,314 discloses resin compositions which employ branched chain high molecular weight ester derivatives of monocarboxylic acids. These monocarboxylic acids can be of a type commonly known as a telomer acid. U.S. Pat. No. 4,283,314 is incorporated herein in its entirety by reference.

Additives effective in lubricating oils are not necessarily effective in distillate fuels. It is also known that additives which affect pour point cannot be presumed to affect other low temperature properties such as cloud point or filterability.

U.S. Pat. No. 3,962,104 discloses lubricating oil compositions containing minor amounts of quaternary ammonium salts useful as an oil improving additive. The quanternary ammonium salts utilize a cation derived from the reaction product of one molar proportion of a tertiary amine with one or more molar proportions of an olefin and an amount of water in excess of stoichiometric.

U.S. Pat. No. 4,491,455 describes $C_{12}$–$C_{30}$ linear fatty acid esters of hydroxyamines useful as a means of improving the cold flow of hydrocarbon fuel oils.

None of these prior art materials, however, utilize the specific branched chain acids or reaction products as described below or provide the breakthrough in cold flow plugging point and pour point depression of distillate fuels to ensure proper performance at low temperatures.

The additives in accordance with this invention unlike prior art cold flow improving additives, are useful in a broad range of distillate or diesel fuels. Generally speaking, prior art additives have been rather specific, being useful in one or two fuels at most.

One object of this invention is to provide additive products which will operate to lower to pour point and cloud point of hydrocarbon fuels and improve their filterability.

Another object is to provide diesel fuel oil compositions of improved low temperature characteristics.

SUMMARY OF THE INVENTION

Applicants have now discovered that ester derivatives of specific branched-chain acids known as telomer acids in which the derivative contains at least one tertiary amine group provides an additive product which both improves the filterability and reduces the pour point and cloud point of liquid hydrocarbon fuels. This invention is also directed to compositions comprising a hydrocarbyl distillate fuel and the described branched chain acid derivatives.

DESCRIPTION OF SPECIFIC EMBODIMENTS OF THE INVENTION

The invention is directed to a method of improving the low temperature characteristics such as filterability and pour point of distillate hydrocarbyl fuels comprising adding a minor effective amount of an amino-ester derivative of a branched chain carboxylic telomer acid to said diesel fuels.

Suitable distillates generally have an initial boiling point of about 350° F. and an end point of about 675° F. Suitable branched chain carboxylic acids are preferably telomer acids.

A telomer acid in accordance with the present invention is one which ordinarily has a branched chain structure of which at least 10 percent by weight conforms to the following generalized structural formula

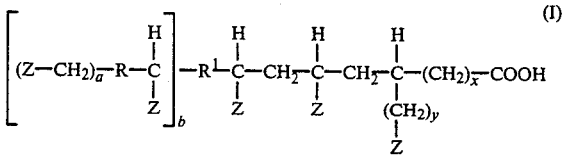

(I)

where Z is $-(CH_2)_nCH_3$; where n is an integer of from 3 to 42; x and y are different and are either 0 or 2; a is 0 or 1, if a is 0, R is hydrogen but if a is 1, R is $-CH_2$; and b is 0 or 1, if b is 0, $R^1$ is hydrogen but if b is 1, $R^1$ is $-CH_2$.

The telomer acids described herein may be prepared by any method known in the art. One convenient method is the free radical addition of one mole of acetic anhydride or acid to at least 3 moles of hexene and/or a higher olefin having up to 30 or more carbon atoms ($C_{30}$+) in the presence of a trivalent manganese compound or in any other convenient manner known in the art. The telomer acids in accordance with the invention generally have side chains of from about 8 to about 18 carbon atoms, i.e., they are prepared from olefins having about 10 to about 2 carbon atoms. Telomer acids are available under the trade name Kortacid through AKZO CHEMIE, Chicago, Ill. Preferred are those made from $C_{10}$–$C_{20}$ olefins. These acids are usually further identified as, for example, Kortacid (Trade name) T-1801 or Kortacid T-1001 where the first two numerals indicate the number of carbon atoms in the side chain. Other highly suitable Kortacids include T-1401, T-2001, T-1402, T-1802 and T-2002.

The ester derivatives may be formed by a simple reaction between the branched chain acid and a suitable diamine to yield the ester derivative or oxyamine having the following generalized structural formula:

$$R^2COO(R^3)N(R^4)(R^5) \qquad \text{(II)}$$

where $R^2$ is a branched chain acid radical preferably telomer having a molecular weight between about 300 and 1000; $R^3$ is hydrocarbyl of from 1 to about 25 carbon atoms and $R^4$ and $R^5$ are the same or different and are $C_1$–$C_{25}$ alkyl or substituted alkyl. Structural formula II represents compounds having only one ester group and only one tertiary amine group, however, the ester derivatives in accordance with the invention may have multiple ester groups and multiple tertiary amine groups. One preferred embodiment is

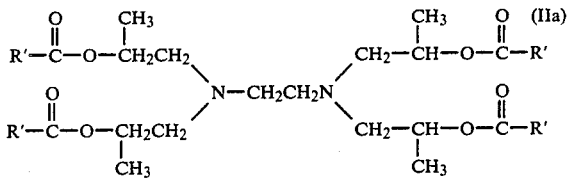

(IIa)

with 4 ester groups and 2 tertiary amine groups in the molecule wherein the R′ group may be the same or different, linear or branched with the proviso that at least one R′ must be a branched chain (preferably telomer) acid radical as described herein; non-branched R′ may be $C_1$–$C_{30}$ hydrocarbyl.

Any suitable amine may be used and any conventional process known to the art may be used to provide the ester derivative. The ester derivative is further defined by the branched chain hydrocarbyl radical $R^2$ having a molecular weight of between about 300 to 1,000. $R^2$, in a preferred embodiment, is a telomer acid radical having the following structural formula:

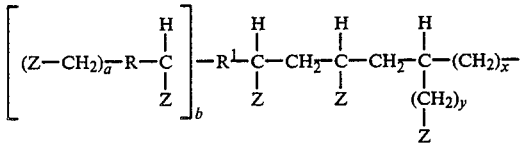

(III)

where Z, R, $R^1$, n, a, b, x and y have the meanings given for structural formula I.

In a particular embodiment the invention is directed to a product of reaction useful for improving the low temperature characteristics of distillate hydrocarbyl fuels comprising an ester derivative of a branched chain monocarboxylic acid having at least one tertiary amine group and having the generalized structural formulae depicted by formulae II and IIa wherein $R^2$ and at least one R′ are telomer radicals having a molecular weight between about 300 and 1000.

In a more preferred embodiment of the present invention, the branched chain monocarboxylic acid has a molecular weight of 400 to 900. Still more preferably, the molecular weight of the branched chain monocarboxylic acid is in the range of between 500 and 800.

Some of the useful amines include but are not limited to N,N,N′N′-tetrakis(2-hydroxyethyl)ethylenediamine, N,N,N′N′-tetrakis(2-hydroxypropyl)ethylenediamine, N,N′,N′-tris-(2-hydroxypropyl)-N-tallowalkyl-1,3-diaminopropane; N-methyldiethanolamine, 3-dimethylaminopropanol and the like and mixtures of two or more of these. Especially preferred is 3-dimethylaminopropanol and N,N,N′,N′-tetrakis(hydroxypropyl)ethylenediamine. All the R groups mentioned are alkyl. Other useful groups can be alkenyl, aryl, alkaryl, aralkyl or cycloalkyl. The aryl moiety will usually contain 6 to 14 carbon atoms.

The above described additive product has been surprisingly found to improve the cold temperature performance of distillate fuels such as diesel fuels, residential fuel oils, aviation jet fuels and the like. This improved performance is manifested by significantly decreased cloud point, pour point and Low Temperature Flow Test (LTFT) temperatures for fuels to which additives/compounds of the present invention are added.

The telomer acid and amine reactants are usually reacted in substantially stoichiometric amounts or equimolar amounts, however, a slight molar excess of either reactant may be used if desired.

The improved cold flow effect manifested by the additives of the present invention to distillate fuels is accomplished by providing a cold flow improving effective amount of the additive compound to a suitable distillate fuel. More preferably, the amount added to the distillate or diesel fuel is in the range of between about 0.01 and 3–5 percent by weight, based on the total weight of the fuel composition. Still more preferably, the concentration of the flow improving product of reaction of the present invention to the distillate fuel is in the range of between 0.02 and 2 percent by weight. In certain cases depending, inter alia, on the particular fuel and/or weather conditions, up to about 10 wt. % may be used. Up to about 10 wt. % or more of other conventional additives may be added to the fuel composition for their known purposes.

The following examples are given to illustrate the present invention. Since these examples are given for illustrative purposes only, the invention embodied therein should not be limited thereto.

EXAMPLE 1

A tetraester of telomer acids was prepared from 66 g Kortacid T-1801 (Akzo Chemie) and 5.7 g Quadrol (BASF Wyandotte: N,N,N′N′-tetrakis[2-hydroxypropyl]ethylenediamine) at 175° C. with azeotropic removal of water. The material had an acid value of 10.1.

EXAMPLE 2

A triester of telomer acids and Propoduomeen T/13 (Armak: N,N′,N′-(2-hydroxypropyl)-N-tallowalkyl-1,3-diaminopropane) was prepared in a similar manner from 168.2 g Kortacid T-1801 and 36.3 g of the aminoalcohol.

EXAMPLE 3

A monoester of the telomer acids was prepared from 174.5 g Kortacid T-1801 and 37.6 g DMAMP (Angus Chemical: an 80% aqueous solution of 3-dimethylaminopropanol) using toluene for azeotropic removal of water at 150° C.

EXAMPLE 4

A diester was prepared from 188.5 g Kortacid T-1801 and 16.5 N-methyldiethanolamine under similar conditions.

EXAMPLE 5

A diester of Kortacid T-1801 and Texaco M-302 was prepared in a similar manner. Texaco M-302 is described as having the approximate composition:

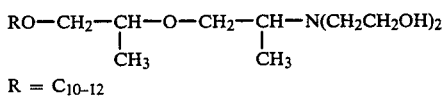

R = $C_{10-12}$

EVALUATION

The materials described in Examples 1 to 5 were blended (0.1 percent by weight) into a typical diesel fuel and tested for pour point (ASTM D-97), cloud point (ASTM D-2500) and filterability by the LTFT procedure described below with the results shown in Table 1. LTFT testing starts at −6° F. A failure at this point indicates essentially no significant reduction from the control base oil test at 1° F. Comparative examples, A, B, C and D were prepared by conventional means and also evaluated in Table 1. Comparative Examples A and B are respectively tri- and tetraesters of a $C_{22}$ linear acid. Comparative Examples C and D are respectively tri- and tetraesters of a non-telomer branched chain $C_{18}$ acid.

LTFT, Low Temperature Flow Test for Diesel Fuels, a filtration test under consideration by CRC (Coordination Research Council). LTFT Procedure: The test sample (200 ml) is gradually lowered to the desired testing temperature at a controlled cooling rate. After reaching that temperature the sample is removed from its cold box and filtered under vacuum through a 17 micrometer screen. If the entire sample can be filtered in less than 60 seconds it shall be considered as having passed the test. An F in this test indicates failure at the maximum acceptable temperature (−6° F). All test results are shown in Table 1.

Any suitable distillate fuel oil or diesel fuel oil may be used in accordance herewith. However, as mentioned hereinabove, fuels having an initial boiling point of about 350° F. and an end point of about 675° F. are preferred. The base diesel fuel used in these tests was a blend of 15% kerosene with 85% of a straight distillate having the characteristics set forth in Table 2.

TABLE 1

| Additive Used | LTFT, °F. | Pour Point, °F. | Cloud Point, °F. |
|---|---|---|---|
| Base Oil, No Additive | 1 | −10 | 6 |
| Comparative Example A Behenic Acid Triester of Quadrol | Failed | −5 | 7 |
| Comparative Example B Behenic Acid Tetraester of Quadrol | Failed | −5 | 9 |
| Comparative Example C Isostearic Acid Triester of Quadrol | Failed | −10 | |
| Comparative Example D Isostearic Acid Tetraester of Quadrol | Failed | −10 | |
| Example 1 | −8 | −40 | 0 |
| Example 2 | −9 | −40 | 2 |
| Example 3 | −8 | −35 | |
| Example 4 | −6 | −45 | |
| Example 5 | −6 | −40 | |

TABLE 2

| | |
|---|---|
| Initial b.p. | 366° F. |
| End Point | 663° F. |
| Viscosity, 40° C. | 2.185 cst |
| Conradson Carbon Residue | 0.04% |
| API Gravity | 34.8 |

The data of Table 1 clearly show the improved results obtained when additive compositions comprising branched chain telomer acid derivatives in accordance with the invention are used. The comparative examples comprising linear acid derivatives and non-telomer acid derivatives failed the most important test, the LTFT test. It is noted again that all of the comparative additives failed the LTFT test and that all of the examples in accordance with the invention passed. It is also noted that the additives of the invention dramatically improve other low temperature characteristics, i.e., pour point and cloud point of the base fuel oil. Accordingly the overall low temperature characteristics of distillate fuels are improved.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A product of reaction useful for improving the low temperature characteristics of distillate hydrocarbyl fuels comprising an ester derivative of a branched chain monocarboxylic acid having at least one tertiary amine group and at least one ester group prepared by reacting substantially stoichiometric or equimolar amounts of said branched chain acid and an amine having at least one tertiary amine group for a time sufficient to obtain said ester derivative and wherein said branched chain acid is a telomer acid.

2. The reaction product of claim 1 wherein said ester derivative has the following generalized structural formula:

$$R^2COO(R^3)N(R^4)(R^5)$$

where $R^2$ is a branched chain monocarboxylic acid radical having a molecular weight between about 300 and 1000; $R^3$ is hydrocarbyl of from 1 to about 25 carbon atoms; $R^4$ and $R^5$ are the same or different and are $C_1$–$C_{25}$ alkyl or substituted alkyl.

3. The reaction product of claim 1 wherein said ester derivative has the following generalized structural formula:

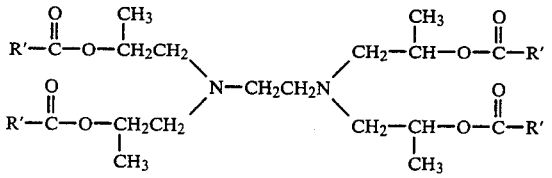

wherein the R′ groups are $C_1$–$C_{30}$ hydrocarbyl, linear or branched and are the same or different with the proviso that at least one R′ must be a branched chain telomer acid radical.

4. A reaction product in accordance with claim 2 wherein said branched chain monocarboxylic acid radicals have a molecular weight in the range of between about 500 and 800.

5. A reaction product in accordance with claim 3 wherein said branched chain monocarboxylic acid radicals have a molecular weight in the range of between about 500 and 800.

6. A reaction product in accordance with claim 1 wherein at least a portion of said telomer acid has the following generalized structural formula:

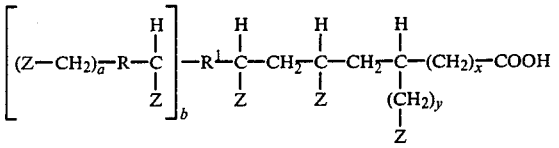

where Z is $-(CH_2)_nCH_3$; n is an integer of from 3 to 42; x and y are different and are 0 or 2; a is 0 or 1; if a is 0, R is hydrogen but if a is 1, R is $-CH_2$; and b is 0 or 1; if b is 0, $R^1$ is hydrogen but if B is 1, $R^1$ is $-CH_2$.

7. The reaction product of claim 1 wherein said ester derivative of said branched chain monocarboxylic acid is prepared by reacting substantially equimolar amounts of said telomer acid and an amine selected from the group consisting esssentially of N,N,N'N'-tetrakis(2-hydroxyethyl)ethylenediamine, N,N,N',N'-tetrakis(2-hydroxypropyl)ethylenediamine, N,N'N'-tris-(2-hydroxypropyl)-N-tallowalkyl-1,3-diaminopropane; 3-dimethylaminopropanol, N-methyldiethanolamine and mixtures of two or more of these.

8. The reaction product of claim 7 wherein said amine is N,N,N',N'-tetrakis(2-hydroxypropyl)ethylenediamine.

9. The reaction product of claim 7 wherein said amine is 3-dimethylaminopropanol.

10. The reaction product of claim 7 wherein said amine is N,N',N'-(2-hydroxypropyl)-N-tallowalkyl-1,3-diaminopropane.

11. The reaction product of claim 7 wherein said amine is N-methyldiethanolamine.

12. The reaction product of claim 6 wherein said ester derivative of said branched chain monocarboxylic acid is prepared by reacting substantially equimolar amounts of said telomer acid and an amine selected from the group consisting essentially of N,N,N'N'-tetrakis(2-hydroxyethyl)ethylenediamine, N,N,N'N'-tetrakis(2-hydroxypropyl)ethylenediamine, N,N'N'-tris-(2-hydroxypropyl)-N-tallowalkyl-1,3-diaminopropane; 3-dimethylaminopropanol, N-methyldiethanolamine and mixtures of two or more of these.

13. The reaction product of claim 12 wherein said amine is N,N,N',N'-tetrakis(2-hydroxypropyl(ethylenediamine.

14. The reaction product of claim 12 wherein said amine is 3-dimethylaminopropanol.

15. The reaction product of claim 12 wherein said amine is N,N',N'-tris-(2-hydroxypropyl)-N-tallowalkyl-1,3-diaminopropane.

16. The reaction product of claim 12 wherein said amine is N-methyldiethanolamine.

17. An additive reaction product useful for improving the low temperature characteristics of a distillate fuel by reducing its cloud point, pour point and LTFT comprising an ester derivative of a branched chain monocarboxylic acid containing at least one tertiary amine group and at least one ester group derived from said branched chain acid prepared by reacting substantially stoichiometric or equimolar amounts of said branched chain acid and an amine having at least one tertiary amine group for a time sufficient to obtain said ester derivative and wherein said branched chain acid is a telomer acid.

18. The additive product of claim 17 having the following generalized structural formula:

$R^2COO(R^3)N(R^4)(R^5)$ where $R^2$ is a branched chain telomer acid radical having a molecular weight between about 300 and 1000; $R^3$ is hydrocarbyl of from 1 to about 25 carbon atoms and $R^4$ and $R^5$ are the same or different and are $C_1$–$C_{25}$ alkyl or substituted alkyl and wherein said branched chain acid has at least one side chain having from about 8 to 18 carbon atoms.

19. The additive product of claim 17 having the following generalized structural formula:

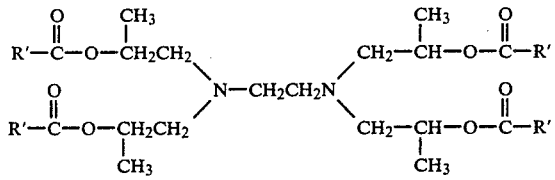

wherein the R' groups are the same or different with the proviso that at least one R' must be a branched chain acid radical branched or non-branched and each R' is $C_1$–$C_{30}$ hydrocarbyl.

20. The additive in accordance with claim 18 wherein said branched chain acid has at least one side chain having about 18 carbon atoms.

21. The additive in accordance with claim 19 wherein said branched chain acid has at least one side chain having about 18 carbon atoms.

22. The additive product in accordance with claim 20 wherein said branched chain acid is a $C_{18}$ telomer acid.

23. The additive product in accordance with claim 21 wherein said branched chain acid is a $C_{18}$ telomer acid.

24. The additive product in accordance with claim 18 wherein said branched chain acid is a $C_{14}$ telomer acid.

25. The additive product in accordance with claim 19 wherein said branched chain acid is a $C_{14}$ telomer acid.

26. The additive product in accordance with claim 18 wherein said branched chain acid is a $C_{20}$ telomer acid.

27. The additive product in accordance with claim 19 wherein said branched chain acid is a $C_{20}$ telomer acid.

28. The reaction product of claim 19 wherein said ester derivative of said branched chain monocarboxylic acid is prepared by reacting substantially equimolar amounts of said telomer acid and an amine selected from the group consisting essentially of N,N,N'N'-tetrakis(2-hydroxyethyl)ethylenediamine, N,N,N'-tetrakis(-2-hydroxypropyl)ethylenediamine, N,N'N'-tris-(2-hydroxypropyl)-N-tallowalkyl-1,3-diaminopropane, N-methyldiethanolamine, 3-dimethylaminopropanol and mixtures of two or more of these.

29. The reaction product of claim 28 wherein said amine is N,N,N',N'-tetrakis(2-hydroxypropyl)ethylenediamine.

30. The reaction product of claim 28 wherein said amine is 3-dimethylaminopropanol.

31. The reaction product of claim 28 wherein said amine is N,N'N'-tris-(2-hydroxypropyl-N-tallowalkyl-1,3-diaminopropane.

32. The reaction product of claim 28 wherein said amine is N-methyldiethanolamine.

33. A distillate fuel composition comprising a major proportion of a hydrocarbyl distillate fuel and a cold flow improving effective amount of the reaction product defined in claim 1.

34. A distillate fuel composition comprising a major proportion of a hydrocarbyl distillate fuel and a cold flow improving effective amount of the reaction product defined in claim 2.

35. A distillate fuel composition comprising a major proportion of a hydrocarbyl distillate fuel and a cold flow improving effective amount of the reaction product defined in claim 3.

36. A distillate fuel composition comprising a major proportion of a hydrocarbyl distillate fuel and a minor effective proportion of the cold flow improving additive of claim 13.

37. A distillate fuel composition comprising a major proportion of a hydrocarbyl distillate fuel and a minor effective proportion of the cold flow improving additive of claim 14.

38. A distillate fuel composition comprising a major proportion of a hydrocarbyl distillate fuel and a minor effective proportion of the cold flow improving additive of claim 15.

39. A distillate fuel composition comprising a major proportion of a hydrocarbyl distillate fuel and a minor effective proportion of the cold flow improving additive of claim 16.

40. A hydrocarbyl distillate fuel composition comprising a distillate fuel and between about 0.01 and 3–5% by weight, based on the total weight of the fuel composition of the reaction product of claim 1.

41. A method for lowering the pour point, cloud point and the LTFT of hydrocarbyl distillate fuels which comprises adding a minor pour point depressant and LTFT lowering amount of a product of reaction as defined in claim 1.

42. A method for lowering the pour point, cloud point and the LTFT of hydrocarbyl distillate fuels which comprises adding a minor pour point depressant and LTFT lowering amount of a product of reaction as defined in claim 2.

43. A method for lowering the pour point, cloud point and the LTFT of hydrocarbyl distillate fuels which comprises adding a minor pour point depressant and LTFT lowering amount of a product of reaction as defined in claim 3.

* * * * *

UNITED STATES PATENT AND TRADEMARK OFFICE

CERTIFICATE OF CORRECTION

PATENT NO. : 4,639,256

DATED : January 27, 1987

INVENTOR(S) : Joan C. Axelrod & Sheldon Chibnik

It is certified that error appears in the above-identified patent and that said Letters Patent is hereby corrected as shown below:

| | | |
|---|---|---|
| Column 1, | line 43, | After "olefin" insert --oxide--. |
| Column 1, | line 60, | Change "to" (second occurrence) to --the--. |
| Column 2, | line 49, | Change "2" to read --20--. |
| Column 7, | line 45, | Change "(2-hydroxypropyl( to read --(2-hydroxypropyl)-- |

Signed and Sealed this

First Day of December, 1987

*Attest:*

*Attesting Officer*

DONALD J. QUIGG

*Commissioner of Patents and Trademarks*